US011539155B2

(12) United States Patent
Zucca et al.

(10) Patent No.: US 11,539,155 B2
(45) Date of Patent: Dec. 27, 2022

(54) CONTACT ASSEMBLY FOR A CONNECTOR HOUSING, CONNECTOR HOUSING AS WELL AS CONNECTOR ASSEMBLY AND MODULAR CONNECTOR SET WITH SUCH A CONNECTOR HOUSING

(71) Applicants: TE Connectivity Nederland B.V., s'Hertogenbosch (NL); Tyco Electronics UK Ltd., Swindon (GB)

(72) Inventors: Marco Zucca, s'Hertogenbosch (NL); Subhash Mungarwadi, Swindon (GB); Jonathan Catchpole, Swindon (GB)

(73) Assignees: TE Connectivity Nederland B.V., s'Hertogenbosch (NL); Tyco Electronics UK Ltd., Swindon (GB)

( * ) Notice: Subject to any disclaimer, the term of this patent is extended or adjusted under 35 U.S.C. 154(b) by 0 days.

(21) Appl. No.: 17/189,495

(22) Filed: Mar. 2, 2021

(65) Prior Publication Data

US 2021/0281003 A1 Sep. 9, 2021

(30) Foreign Application Priority Data

Mar. 3, 2020 (EP) ..... 20160790

(51) Int. Cl.

| | |
|---|---|
| ***H01R 13/42*** | (2006.01) |
| ***H01R 13/512*** | (2006.01) |
| ***H01R 4/18*** | (2006.01) |
| ***H01R 4/30*** | (2006.01) |
| ***H01R 13/627*** | (2006.01) |

(52) U.S. Cl.

CPC ..... *H01R 13/42* (2013.01); *H01R 13/512* (2013.01); *H01R 4/184* (2013.01); *H01R 4/30* (2013.01); *H01R 13/6272* (2013.01)

(58) Field of Classification Search

CPC .... H01R 13/434; H01R 13/42; H01R 13/512; H01R 13/6272; H01R 4/184; H01R 4/30

USPC ..... 439/745

See application file for complete search history.

(56) References Cited

U.S. PATENT DOCUMENTS 4,412,718 A * 11/1983 Pfister ..... H01R 13/18 29/874

4,938,720 A * 7/1990 Romak ..... H01R 13/18 439/745

(Continued)

FOREIGN PATENT DOCUMENTS

CN 105940569 A 9/2016

OTHER PUBLICATIONS

Extended European Search Report, dated Jun. 15, 2020, 15 pages.

*Primary Examiner* — Gary F Paumen

(74) *Attorney, Agent, or Firm* — Barley Snyder

(57) ABSTRACT

A contact assembly for a connector housing includes an adapter element and a contact element. The adapter element has a sleeve with a lead-through opening extending in an axial direction of the sleeve and with a threaded bore extending perpendicularly to the lead-through opening through the sleeve. The contact element is adapted to be inserted into the lead-through opening and latched to the sleeve. The contact element may exhibit varying types of a cable connection section and/or a contact section. The adapter element is receivable within the connector housing and may accept the contact element regardless of the type of cable connection section and/or contact section.

17 Claims, 8 Drawing Sheets

(56) References Cited

U.S. PATENT DOCUMENTS

| | | | | |
|---|---|---|---|---|
| 5,240,439 | A * | 8/1993 | Egenolf | H01R 13/18 439/745 |
| 5,934,945 | A | 8/1999 | Petersen et al. | |
| 8,992,266 | B2 | 3/2015 | Schmidt et al. | |
| 10,033,132 | B2 | 7/2018 | Baldwin | |
| 2015/0303617 | A1 | 10/2015 | Smith et al. | |
| 2016/0301152 | A1* | 10/2016 | Bertsch | H01R 13/426 |

* cited by examiner

CONTACT ASSEMBLY FOR A CONNECTOR HOUSING, CONNECTOR HOUSING AS WELL AS CONNECTOR ASSEMBLY AND MODULAR CONNECTOR SET WITH SUCH A CONNECTOR HOUSING

CROSS-REFERENCE TO RELATED APPLICATIONS

This application claims priority under 35 U.S.C. § 119 to European Patent Application No. 20160790.0, filed on Mar. 3, 2020.

FIELD OF THE INVENTION

The present invention relates to a contact assembly, and more specifically, to a contact assembly for a connector housing.

BACKGROUND

In the field of electrical engineering, connectors are utilized, often temporarily, to allow for power transfer between two spaced-apart electrical units, such as an electrical power source and an electrical load. More specifically, connectors establish an electrical connection between wire ends of an electrical cable of one electrical unit and wire ends of an electrical cable of the other electrical unit. These wire ends commonly comprise a suitable contact attached to the wire ends using a wire termination method. The contacts serve the function of improving the connector's performance in terms of electrical resistance, wear resistance, vibration resistance and comparable specifications. Due to the large number of different applications and an equally large number of different requirements, a variety of contact types and wire termination methods is conventionally available. As connectors and especially connector housings are usually designed specifically for use with a certain contact type, proportionately vast product portfolios and product families result. Moreover, connectors are often required to fulfil differing standards of safety, which further increases the product portfolios and product families. In general, this leads to overall increased efforts for manufacturing, stocking and transporting of connectors and connector housings.

Therefore, it is desirable for connectors and especially connector housings to serve a wide range of applications, while keeping design variations at a minimal level.

SUMMARY

In one embodiment of the present disclosure, a contact assembly for a connector housing is provided. The contact assembly includes an adapter element and a contact element. The adapter element has a sleeve with a lead-through opening extending in an axial direction of the sleeve, and with a threaded bore extending perpendicularly to the lead-through opening through the sleeve. The contact element is adapted to be inserted into the lead-through opening, e.g., along an insertion direction substantially parallel to the axial direction, and latched to the sleeve.

BRIEF DESCRIPTION OF THE DRAWINGS

The invention will now be described by way of example with reference to the accompanying Figures, of which.

DETAILED DESCRIPTION OF THE EMBODIMENTS

Figure 1:
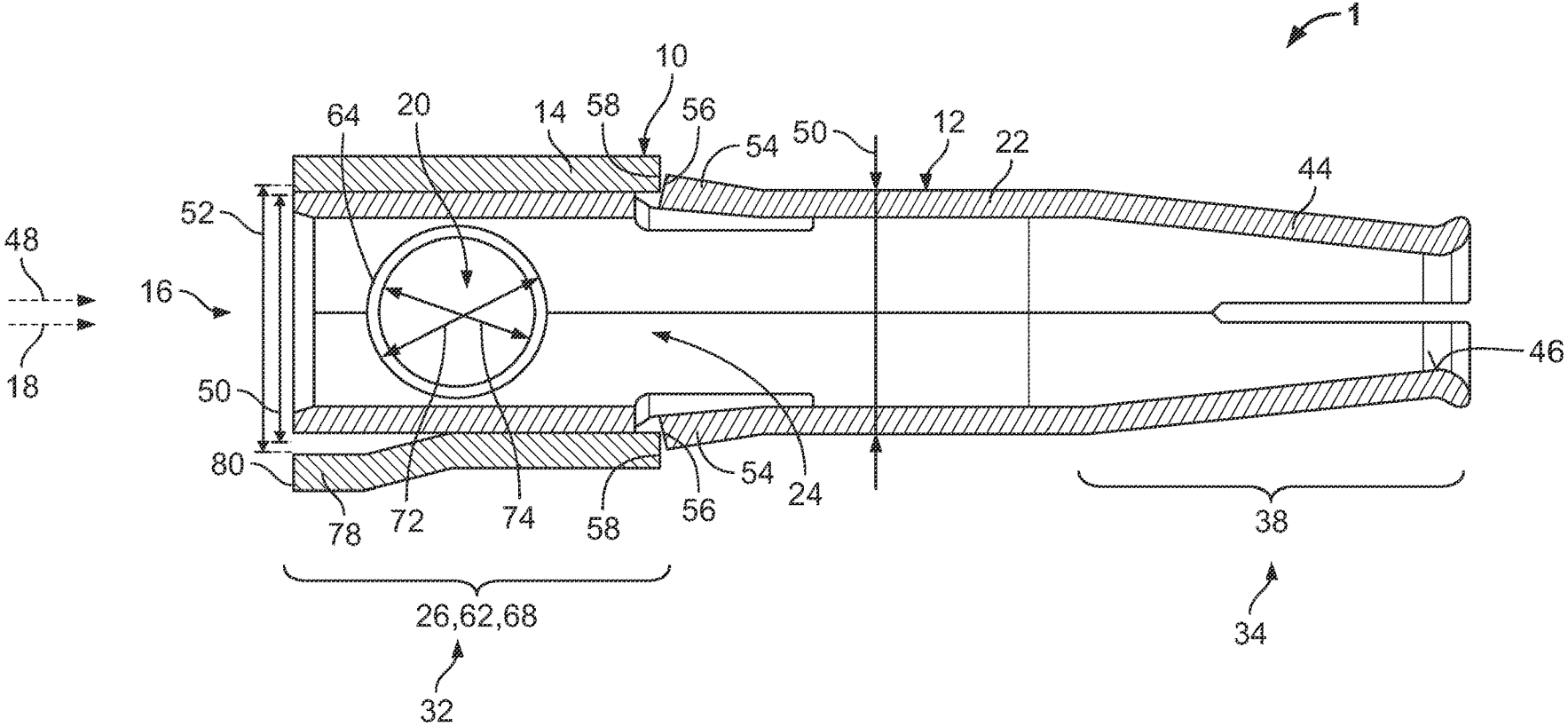
FIG. 1 shows a schematic rendition of a sectional view through a contact assembly according to one possible embodiment of the present disclosure.

Technical solutions of the present disclosure will be described hereinafter in detail through embodiments and with reference to the attached drawings. In the specification, the same or the like reference numerals refer to the same or the like elements. The illustration of the embodiments of the present disclosure made with reference to the attached drawings is aimed to explain the general inventive concept of the present disclosure, not to be construed as a limitation of the present disclosure.

In addition, in the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawings.

Referring now to the figures, the structure of possible embodiments of a contact assembly 1, a contact set 2 and a connector housing 4 according to the present disclosure is explained with reference to the exemplary embodiments shown in FIGS. 1 to 4. Further below, FIGS. 5A to 8 are used for explaining the structure of possible embodiments of a connector assembly 6 and a modular connector set 8 according to the present disclosure.

FIG. 1 shows a sectional view of the contact assembly 1 according to one possible embodiment of the present disclosure, the contact assembly 1 comprising an adapter element 10 and a contact element 12. The adapter element 10 is shown having a preferably hollow, cylindrical sleeve 14 with a lead-through opening 16 extending in an axial direction 18 of the sleeve 14. A threaded bore 20 extends perpendicularly to the lead-through opening 16 through the sleeve 14. The threaded bore 20 preferably comprises at least three threads.

The contact element 12 may have a substantially tubular shape 22 enclosing an interior 24 of the contact element 12. In particular, the contact element 12 may comprise a cable connection section 26 for attaching a conductor 28 of an electrical cable 30, the cable connection section 26 being positioned at one axial end 32, and at another axial end 34 opposite to the cable connection section 26, one of a male contact section 36 and female contact section 38 may be positioned. The male contact section 36 may be shaped as a pin 40 and have an outwardly facing contact surface 42 (see FIG. 2). The female contact section 30 may be shaped as a bushing 44 configured to be mated with the pin-shaped male contact section 36; the bushing 44 may accordingly have an inwardly facing contact surface 46, and in the exemplary embodiment of FIG. 1, such a female contact section 38 is shown.

Further in FIG. 1, the contact element 12 is shown inserted along an insertion direction 48, which is substantially parallel to the axial direction 18, into the lead-through opening 16 of the sleeve 14. For this, an outer diameter 50 of the cable connection section 26 and/or contact section 36, 38 is equal to or smaller than an inner diameter 52 of the lead-through opening 16.

Moreover, the contact element 12 is shown to be latched to the sleeve 14. In particular, at least one latching wing 54, preferably a pair of latching wings 54, may obliquely protrude outward from the contact element 12. The pair of latching wings 54 may be arranged on radially opposite sides of the contact element 12. In particular, free ends 56 of the pair of latching wings 54 may face against the insertion direction 48 and abut against a front face 58 of the sleeve 14. Thus, the contact element 12 may be secured to the adapter element 10 against an axial load directed against the insertion direction 48.

Figure 2:
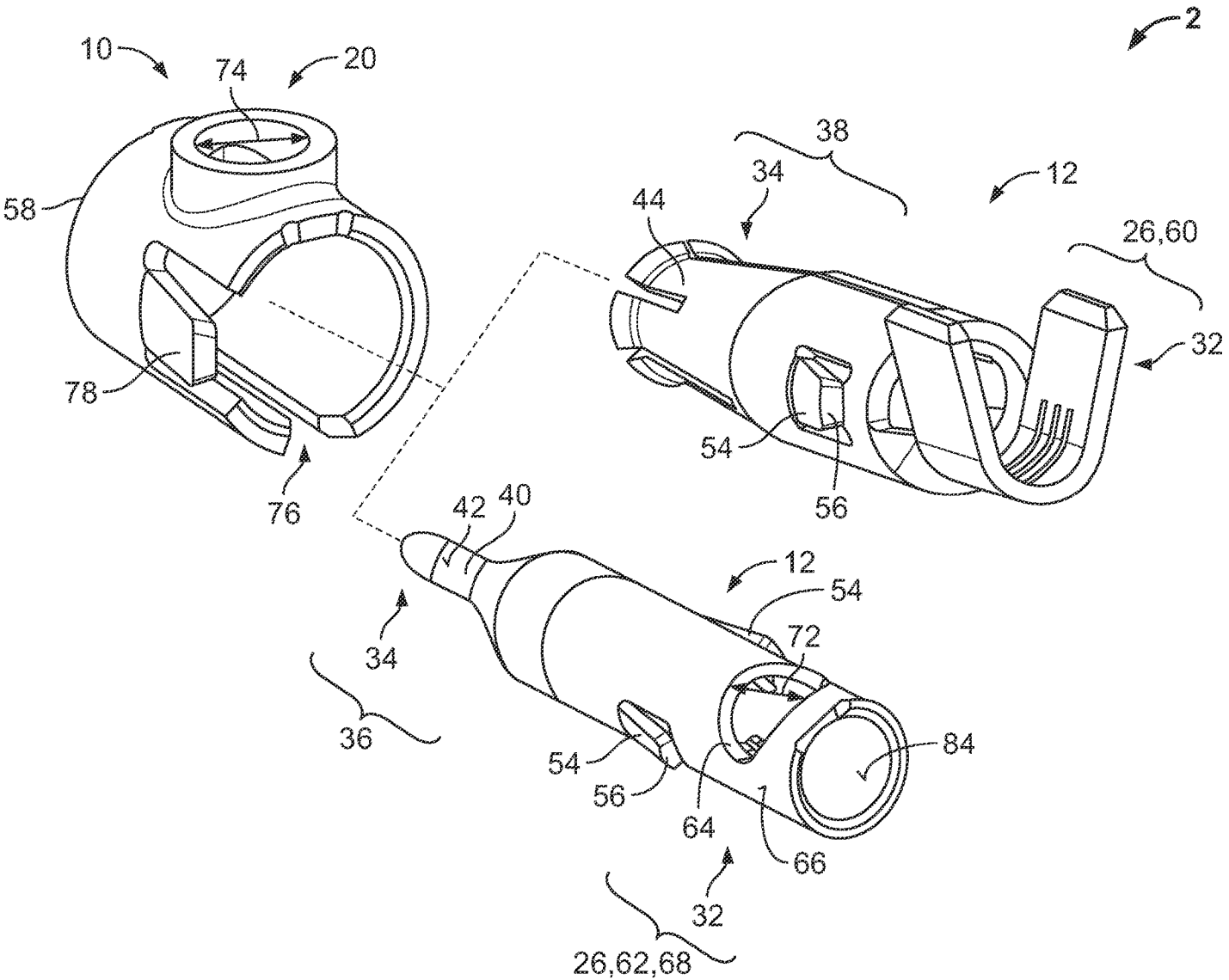
FIG. 2 shows a schematic rendition of a perspective view of a contact set according to one possible embodiment.

With reference now to FIG. 2, the contact set 2 can be seen in a perspective view. The contact set 2 may comprise an adapter element 10 according to the above explained embodiment. Further, the contact set 2 may comprise at least two contact elements 12 from the group comprising a contact element 12 having a male contact section 36, a contact element 12 having a female contact section 38, a contact element 12 having a crimp-type connection section 60, and a contact element 12 having a screw-type connection section 62, any of the at least two contact elements 12 may be inserted and latched to the adapter element 10.

As can be further seen from FIG. 2, the cable connection section 26 of one of the at least two contact elements 12 may be the crimp-type connection section 60 configured to be crimped onto the conductor 28. Alternatively, the cable connection section 26 of the other one of the at least two contact elements 12 may be the screw-type connection section 62, having a screw hole 64 extending through a circumferential surface 66 of the contact element 12 at the cable connection section 26. In particular, the cable connection section 26 may be a hollow, circular tube section 68 and the screw hole 64 may be adapted, in terms of size and position, to receive a screw 70, which is screwed into the threaded bore 20 of the adapter element 10, so as to clamp the conductor 28 within the circular tube section 68. Especially, the screw hole 64 may have a diameter 72 equal to or larger than a diameter 74 of the threaded bore 20. Further, the screw hole 64 may be radially aligned with the threaded bore 20, this alignment being shown in FIG. 1.

It is to be understood that the contact set 2 shall not be limited to the combination shown in FIG. 2. According to the application, any combination of different or identical cable connection sections 26 and contact sections 36, 38 may be applied to the at least two contact elements 12.

The shown adapter element 10 and/or contact elements 12 may be stamped and bent parts, in particular made from sheet metal, such as copper. Alternatively, the adapter element 10 and/or contact elements 12 may be manufactured by means of molding, forging, machining and/or any other, preferably automatable, metal working process.

Optionally, the adapter element 10 may exhibit an axial slit 76 extending through the sleeve 14 along the axial direction 18 of the sleeve 14. By way of example, the position of the axial slit 76 is shown opposite to the threaded bore 20. The axial slit 76 may extend across the entire axial length of the adapter element 10.

The adapter element 10 is further shown in FIG. 2 having at least one latching flap 78 obliquely protruding outwards from the sleeve 14. In an optional embodiment of the adapter element 10, a pair of such latching flaps 78 may be provided on radially opposite sides of the contact element 12. Each free end 80 of the latching flaps 78 may face against the insertion direction 48.

In case of a contact element 12 having the screw-type connection section 62, a screw 70 may extend through the threaded bore 20 of the adapter element 10, through the screw hole 64 and into the interior 24 of the contact element 12. The screw 70 may be in a pre-assembled position, only partially extending into the interior 24 of the contact element 12. From the pre-assembled position, the screw 70 may be further screwed inwards up to a clamping position, in which the conductor 28 is clamped between a tip 82 of the screw 70 and an inner surface 84 of the circular tube section 68 of the contact element 12.

Figure 3:
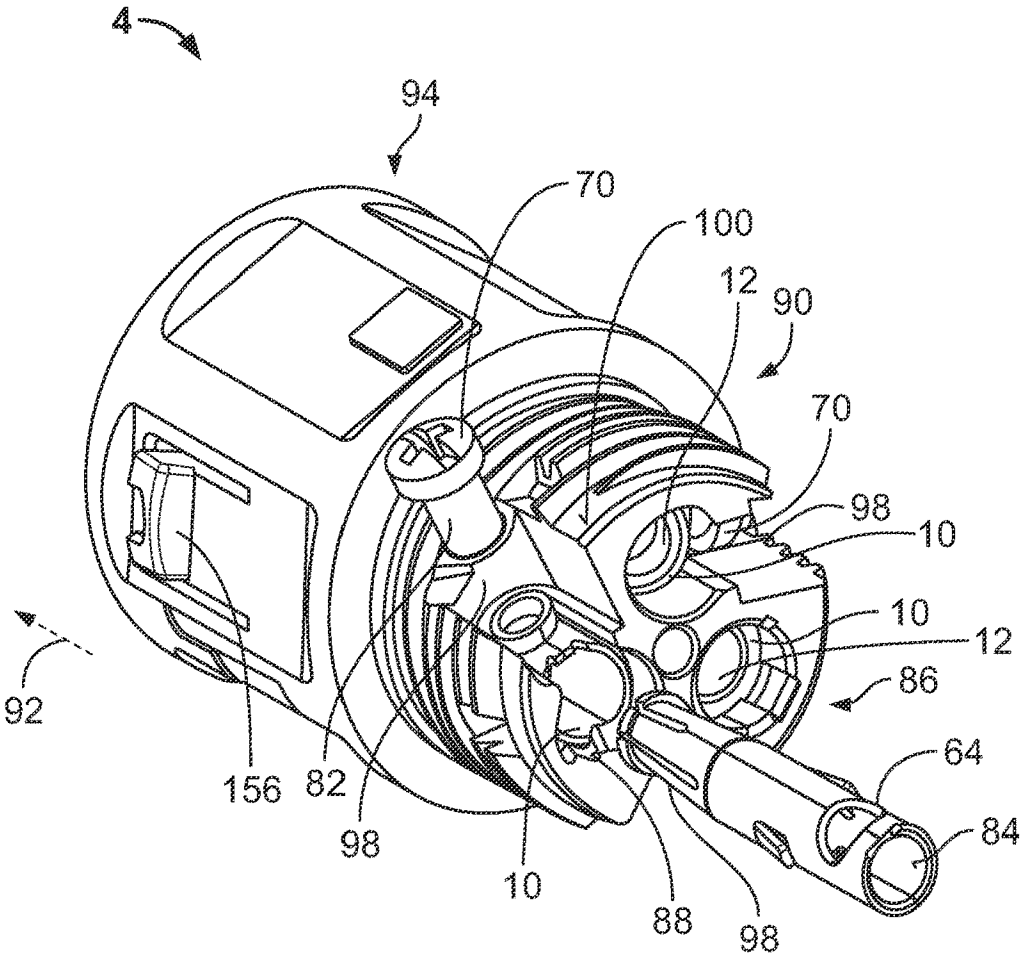
FIG. 3 shows a schematic rendition of a partially exploded, perspective view of a connector housing having three lead-through chambers according to one possible embodiment.

FIG. 3 shows the connector housing 4 in a perspective view, the connector housing 4 comprising at least one lead-through chamber 86, in which at least one adapter element 10 is received. For this, the at least one lead-through chamber 86 exhibits an internal surface segment 88, which is formed complementarily to the shape of the at least one adapter element 10.

By way of example, three lead-through chambers 86 each receiving one adapter element 10 are disclosed. Further, in each lead-through opening 16 of each adapter element 10, any one contact element 12 of the above described embodiments may be selectively inserted and latched to the adapter element 10.

The at least one lead-through chamber 86 preferably extends from a back side 90 of the connector housing 4 along a mating direction 92 and leads to a front side 94 of the connector housing 4. Thus, each contact element 12 may be mated at the front side 94 of the connector housing 4, while being connected to the conductor 28 of the electrical cable 30 at the back side 90 of the connector housing 4.

Figure 4:
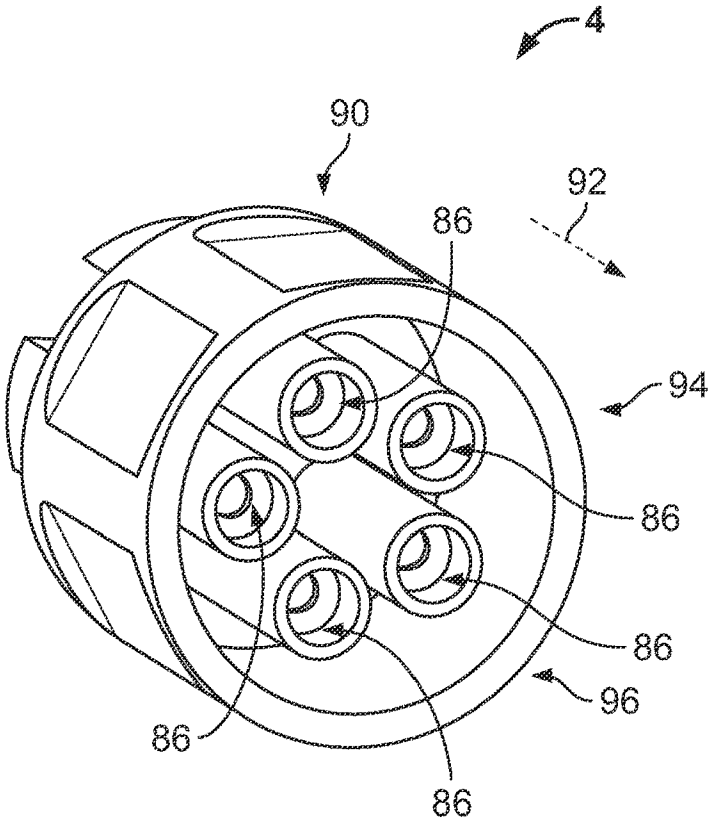
FIG. 4 shows a schematic rendition of a perspective view of the connector housing having five lead-through chambers according to another possible embodiment.

In particular, the at least one lead-through chamber 86 leads to a receptacle cavity 96 at the front side 94 of the connector housing 4. This is shown in FIG. 4, in the perspective view of a connector housing 4 comprising five lead-through chambers 86. The number and position of the at least one lead-through chamber 86 and all components received therein may vary according to the application of the connector housing 4. For instance, an application involving one ground wire, one neutral wire, and one line wire may require three lead-through chambers 86, whereas an application involving one ground wire, one neutral wire, and three line wires may require five lead-through chambers 86.

For each lead-through chamber 86, the connector housing 4 may comprise a lateral slot 98 at least partially aligned with the threaded bore 20 of the adapter element 10 received within the respective lead-through chamber 86. As shown in FIG. 3, the lateral slot 98 connects the respective lead-through chamber 86 with an outer surface 100 of the connector housing 4. The screw 70 may be accessed via the lateral slot 98, while being in the pre-assembled position or the clamping position. In particular, the screw 70 may reach through the lateral slot 98, while a head of the screw 70 may be positioned opposite to a, preferably radial, shoulder at an axial end of the lateral slot 98.

Figure 6:
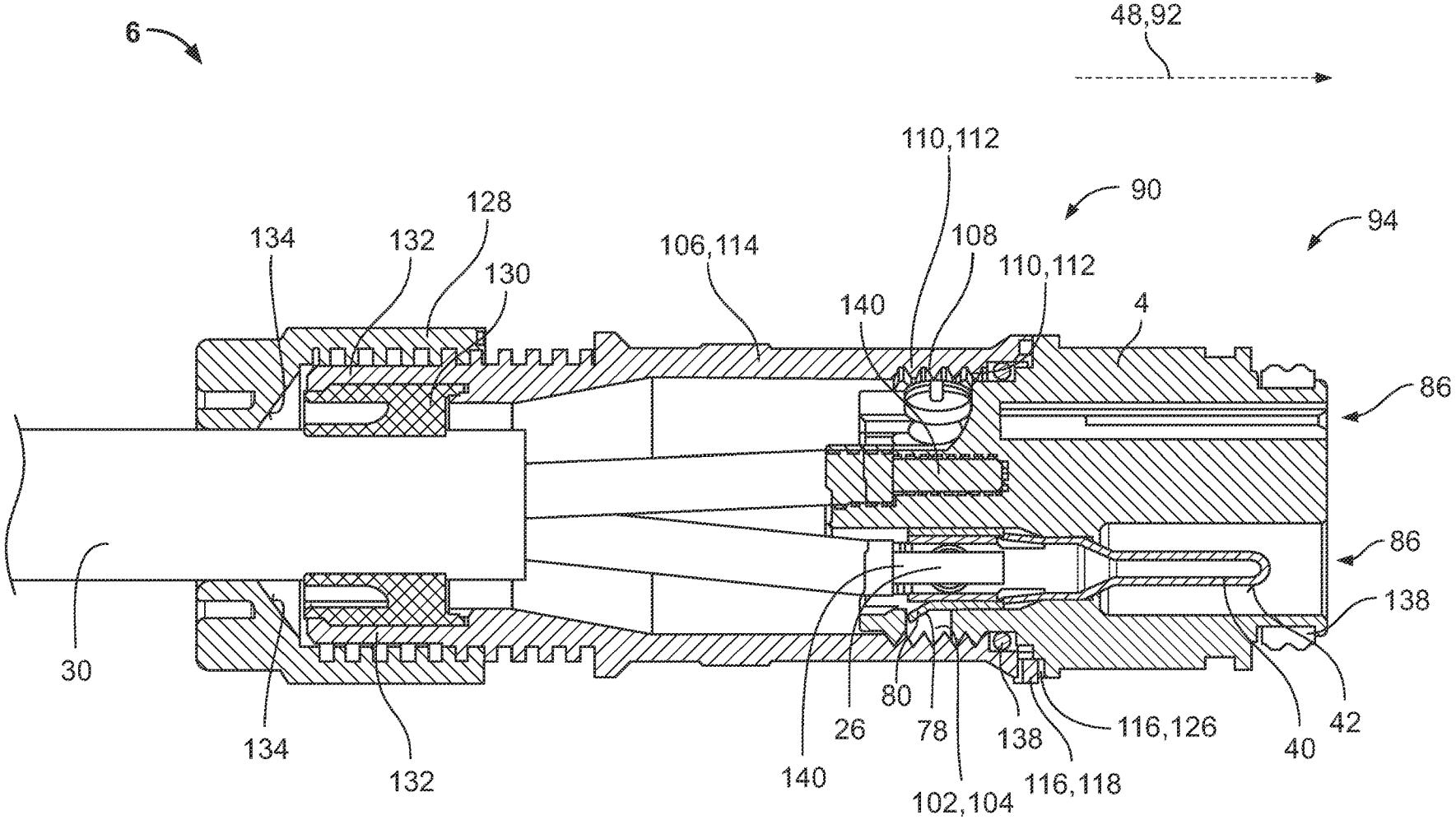
FIG. 6 shows a schematic rendition of a sectional view of the connector assembly according to another possible embodiment.

Further, each lead-through chamber 86 may have a recess 102 formed on the internal surface segment 88, wherein the recess 102 may function as a latching groove 104 for engaging with the at least one latching flap 78 of the adapter element 10. This is shown in FIG. 6.

Figure 5A:
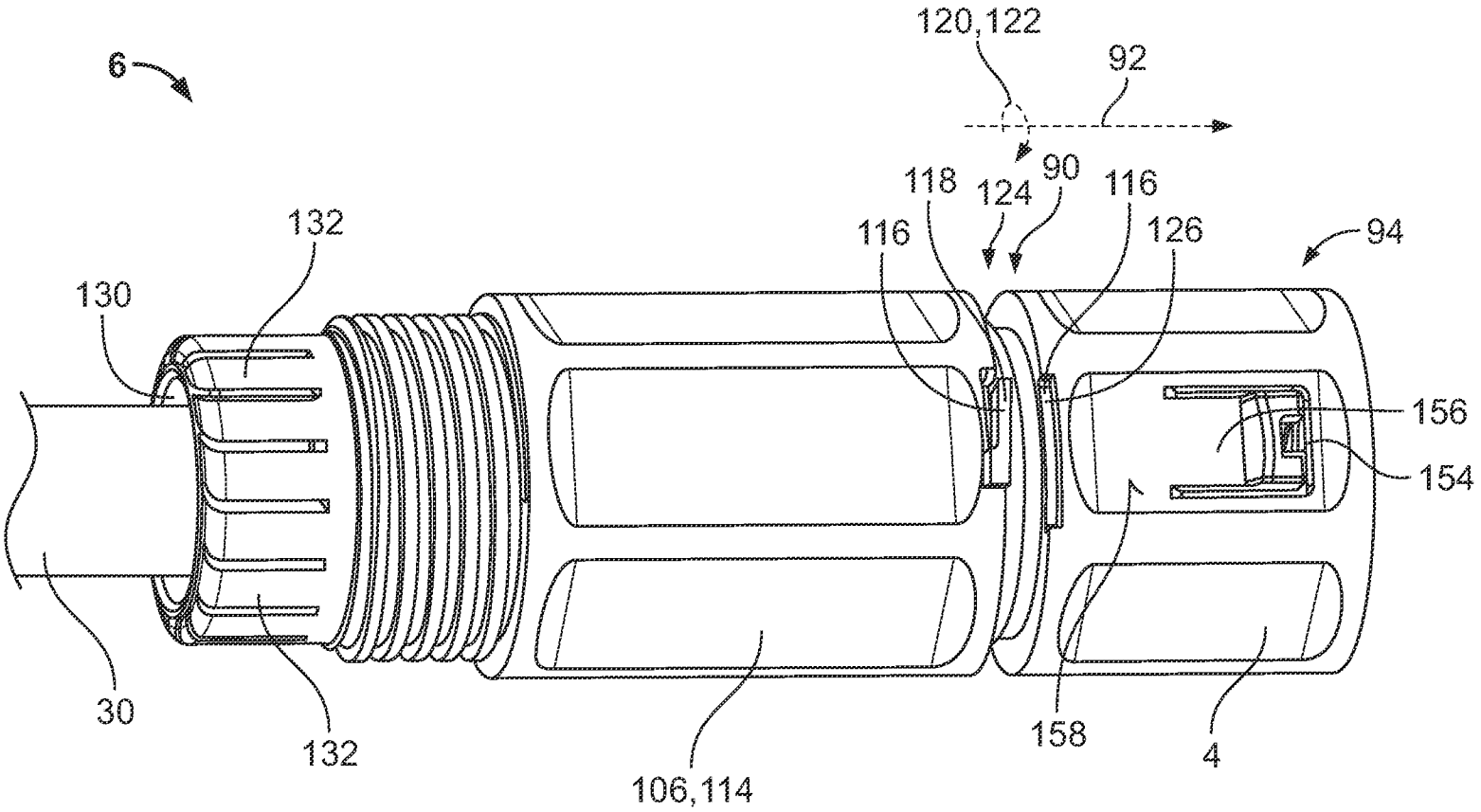
FIG. 5A shows a schematic rendition of a perspective view of a connector assembly according to one possible embodiment.
Figure 5B:
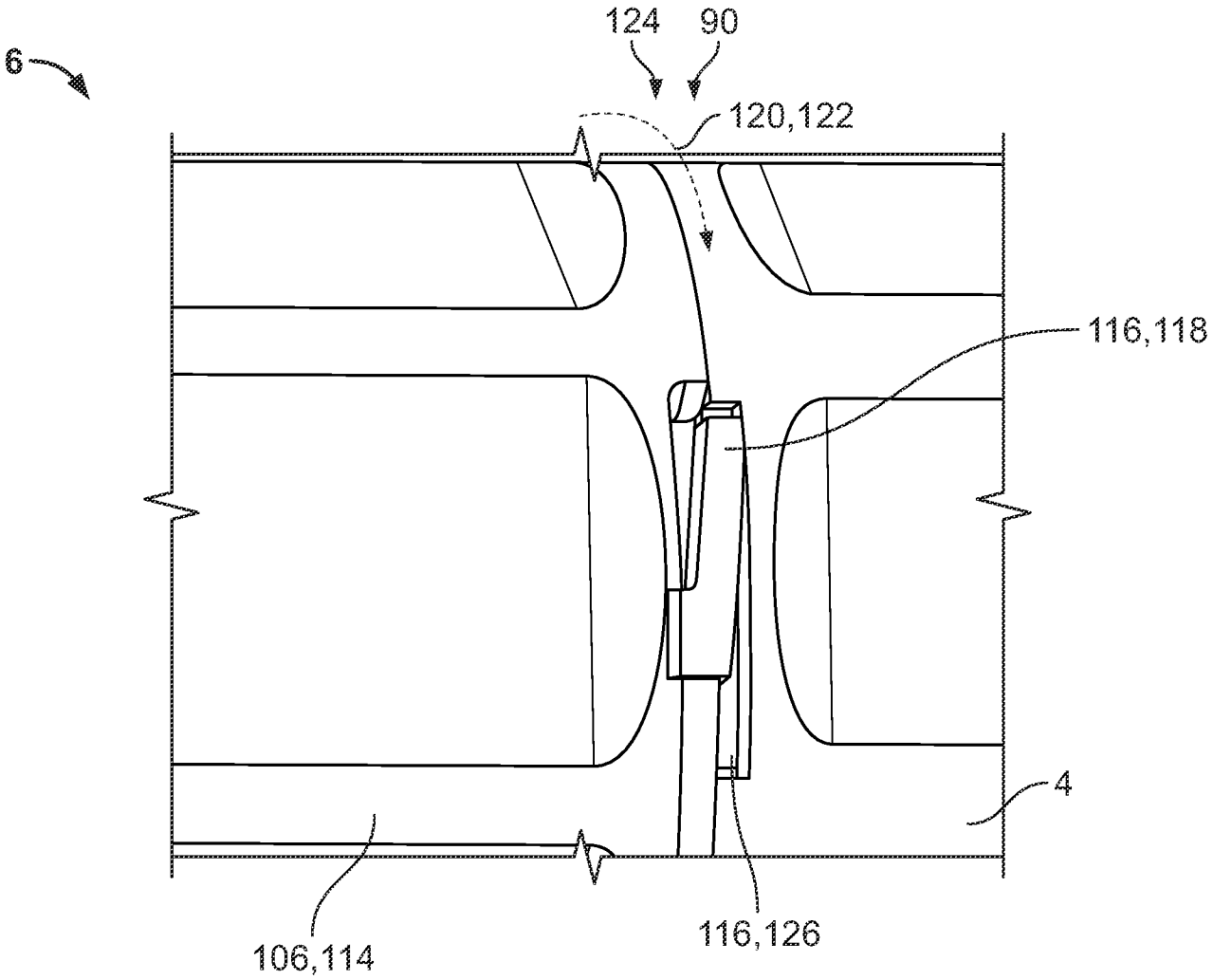
FIG. 5B shows a partially enlarged schematic view of the connector assembly according to the embodiment shown in FIG. 5A.

The connector assembly 6 disclosed in FIGS. 5A and 5B may comprise a connector housing 4 according to the above description and a back shell 106, which is coupled to the connector housing 4 by a rotational coupling 108. In particular, a coupling element 110 adapted to rotatably couple the back shell 106 to the connector housing 4 may be provided on each of the back shell 106 and the connector housing 4. More specifically, the connector housing 4 and the back shell 106 may each comprise, preferably integrally, formed complementary threads 112*a*, 112*b*, which are configured to screw the back shell 106 onto the back side 90 of the connector housing 4. Thus, the back shell 106 may function as an axial cover 114 of the at least one lead-through chamber 86 of the connector housing 4.

As an alternative, the rotational coupling 108 may be established by bayonet elements (not shown) provided on each of the back shell 106 and the connector housing 4.

According to an entirely optional embodiment, a latching structure 116 configured to secure a relative rotational position of the connector housing 4 and the back shell 106 may be formed on each of the connector housing 4 and the back shell 106. Particularly, an axially deflectable latching finger 118 may point against a screw-on direction 120 and extend along a circumferential direction 122 on a front side 124 of the back shell 106 facing the back side 90 of the connector housing 4. A latching notch 126 may be formed accordingly on the back side 90 of the connector housing 4, extending in the circumferential direction 122 and adapted for receiving the latching finger 118 there within. The allocation of the latching finger 118 and the latching notch 126 may also be reversed between the connector housing 4 and the back shell 106.

Preferably, the latching structures 116 of the connector housing 4 and of the back shell 106 are configured to automatically engage at an end position of the rotational coupling 108. For this, an angular offset between the latching notch 126 and the thread 112*a* formed on the connector housing 4 may be equal to an angular offset between the latching finger 118 and the thread 112*b* formed on the back shell 106.

In another embodiment, the connector assembly 6 further comprises a screw-mountable cable nut 128, which may be sleeved over the electrical cable 30 and screwed onto the back shell 106 for securing a seal ring 130 held within the back shell 106.

Optionally, the seal ring 130 may be held by a plurality of flexible tabs 132 extending against the mating direction 92 and arranged around the seal ring 130 along the circumferential direction 122. The cable nut 128 may have an internal conical surface 134 widening in the mating direction 92 and facing the flexible tabs 132. Upon screwing of the cable nut 128 onto the back shell 106, the internal conical surface 134 may deflect the flexible tabs 132 inwards, thereby compressing the seal ring 130 and clamping the electrical cable 30.

Figure 8:
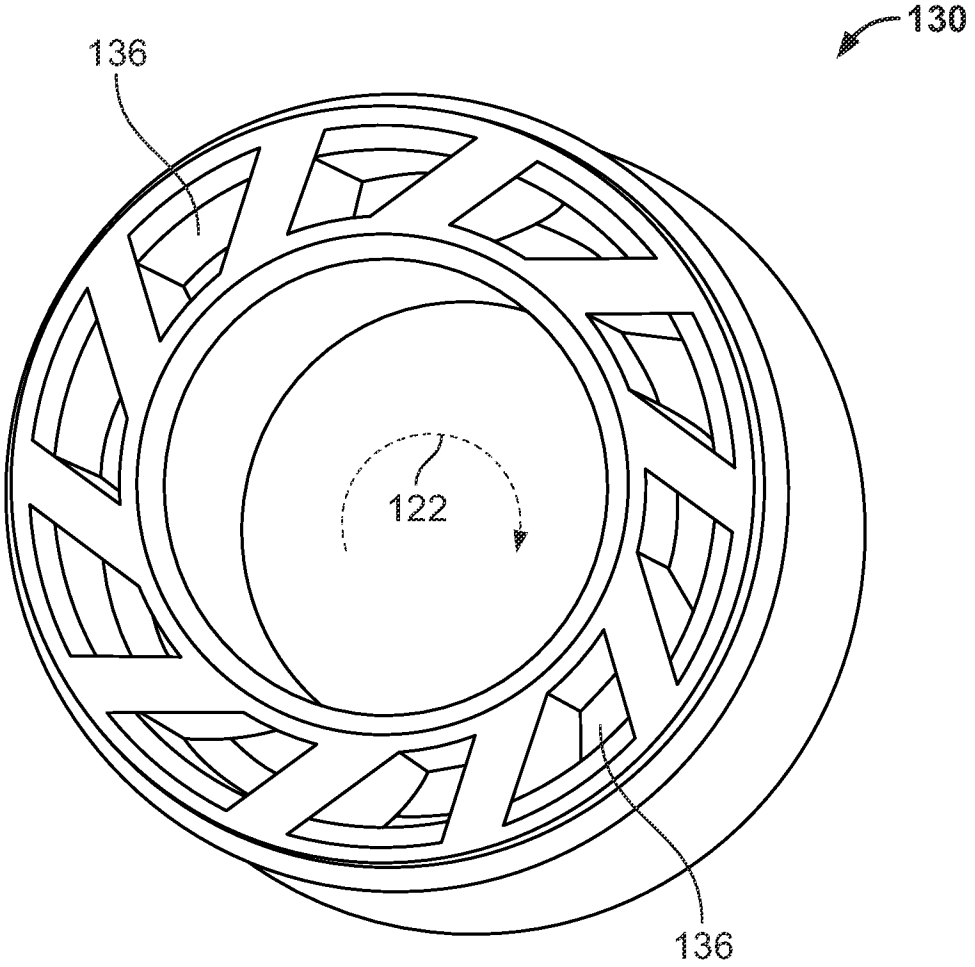
FIG. 8 shows a schematic rendition of a perspective view of a seal ring of the connector assembly according to one possible embodiment of the present disclosure.

As shown in the exemplary embodiment of FIGS. 6 and 8, the seal ring 130 may exhibit an annular ring-shape with a plurality of hollow pockets 136 distributed around the circumferential direction 122. Additional seal rings 138 may be provided on the front side 94 and/or the back side 90 of the connector housing 4. This is shown for instance in FIG. 6.

Still referring to FIG. 6, a sectional view of the connector assembly 6 in a sealed embodiment can be seen. The connector assembly 6 further comprises an electrical cable 30 with multiple conductors 28 extending through the cable nut 128, the seal ring 130, the back shell 106 and into the connector housing 4. In particular, stripped ends 140 of the conductors 28 are exemplarily shown to be clamped within the screw-type connection sections 62 of contact elements 12 having a male contact section 36 and being inserted into adapter elements 10 received within lead-through chambers 86. Depending on the application of the connector assembly 6, the contact elements 12 may instead comprise crimp-type connection sections 60 and/or female contact sections 38.

Figure 7:
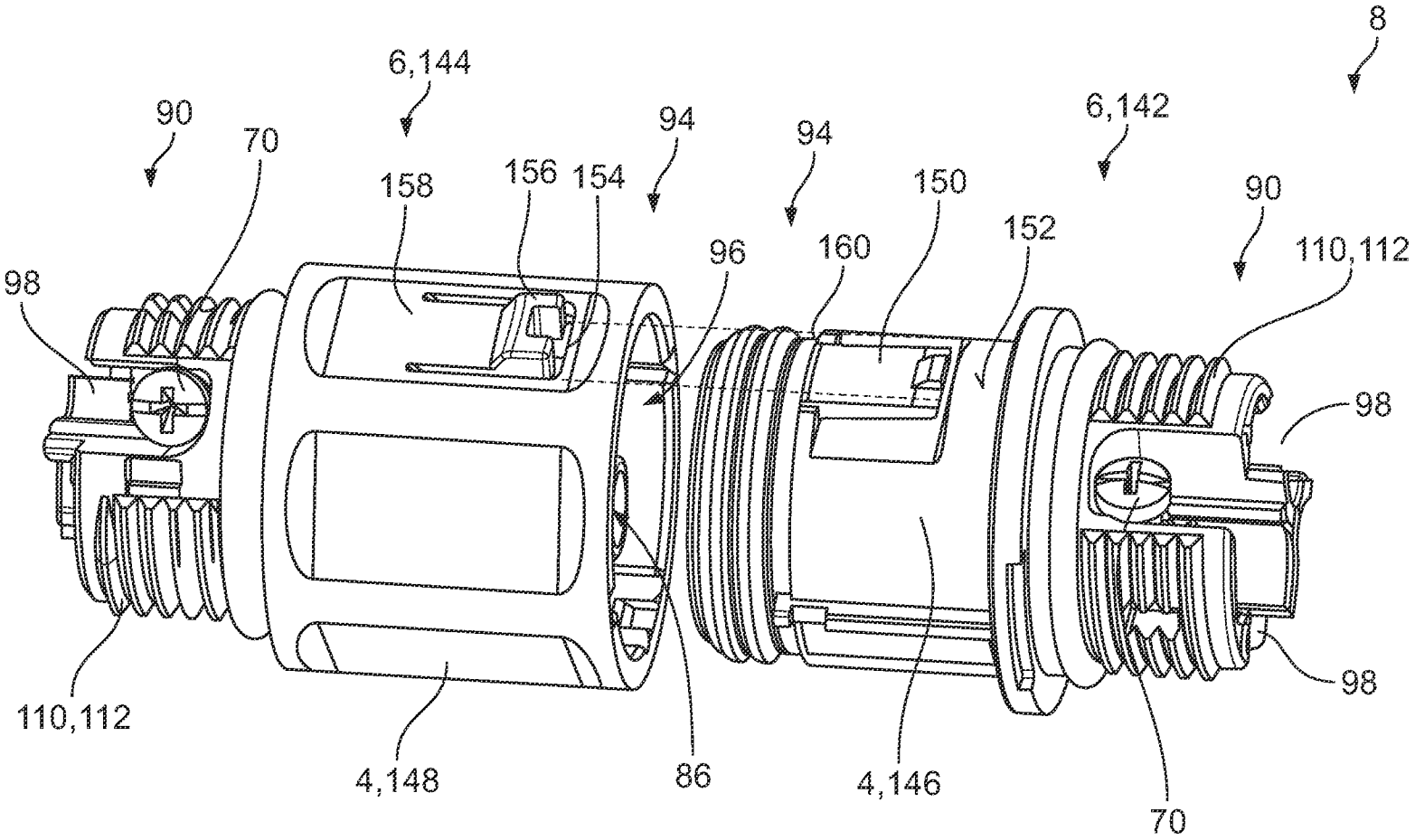
FIG. 7 shows a schematic rendition of a perspective view of a modular connector set according to one possible embodiment.

FIG. 7 shows a perspective view of the modular connector set 8 comprising a first connector assembly 142 and a second connector assembly 144, each being a connector assembly according to the above description. For the sake of brevity, the connector housing 4 of the first connector assembly 142 will be referred to as the first connector housing 146. Accordingly, the connector housing 4 of the second connector assembly 144 will be referred to as the second connector housing 148.

Preferably, the first connector housing 146 is configured to be mounted to the second connector housing 148. For this, the front side 94 of the first connector housing 146 may be shaped complementarily to the receptacle cavity 96 of the second connector housing 148 or vice versa.

The modular connector set 8 may further comprise at least one male contact embodied by at least one contact element 12 having a male contact section 36 and at least one female contact embodied by at least one contact element 12 having a female contact section 38, in particular, the at least one female contact is configured to be mated to the at least one male contact. Moreover, each of the at least one male contact and the at least one female contact may be selectively inserted into any lead-through opening 16 of any adapter element 10 received within any one of the first connector housing 146 and the second connector housing 148.

In another entirely optional embodiment of the modular connector set 8, the first connector housing 146 may comprise at least one, preferably cantilever, latching hook 150 adapted to engage in a latching connection with the second connector housing 148. More specifically, the at least one latching hook 150 may be, preferably monolithically, formed on a lateral-side 152 of the first connector housing 146 extending from the front side 94 of the first connector housing 146 towards the back side 90 of the first connector housing 146. Upon mounting of the first connector housing 146 to the second connector housing 148, the at least one latching hook 150 may wholly enter the receptacle cavity 96 of the second connector housing 148. Thus, the at least one latching hook 150 may engage in the latching connection with at least one latching edge 154 formed in the receptacle cavity 96 of the second connector housing 148.

Further, the second connector housing 148 may comprise at least one, preferably cantilever, button 156 for disengaging the latching connection between the at least one latching hook 150 and the at least one latching edge 154. In particular, the at least one button 156 may be, preferably monolithically, formed on a lateral-side 158 of the second connector housing 148 extending from the back side 90 of the second connector housing 148 towards the front side 94 of the second connector housing 148 at a position 160, which radially overlaps with the at least one latching hook 150 of the first connector housing 146, upon mounting of the first connector housing 146 the second connector housing 148. The button 156 may be specifically adapted to deflect the at least one latching hook 150 inwards, when pressed. Thus, the at least one latching hook 150 may be pushed out of axial alignment with the at least one latching edge 154, making it possible to unmount the first connector housing 146 from the second connector housing 148.

It is to be understood that the allocation of the latching hook 150 and the button 156 may also be reversed between the first connector assembly 142 and the second connector assembly 144.

It should be appreciated by those skilled in this art that the above embodiments are intended to be illustrative, and many modifications may be made to the above embodiments by those skilled in this art, and various structures described in various embodiments may be freely combined with each other without conflicting in configuration or principle.

Although the present disclosure have been described hereinbefore in detail with reference to the attached drawings, it should be appreciated that the disclosed embodiments in the attached drawings are intended to illustrate the preferred embodiments of the present disclosure by way of example, and should not be construed as limitation to the present disclosure.

Although several exemplary embodiments have been shown and described, it would be appreciated by those skilled in the art that various changes or modifications may be made to these embodiments without departing from the principles and spirit of the invention, the scope of which is defined by the claims and their equivalents.

It should be noted that, the word "comprise" doesn't exclude other elements or steps, and the word "a" or "an" doesn't exclude more than one. In addition, any reference numerals in the claims should not be interpreted as the limitation to the scope of the present disclosure.

What is claimed is:

1. A contact assembly for a connector housing, comprising:

an adapter element having a sleeve with a lead-through opening extending in an axial direction of the sleeve and with a threaded bore extending perpendicularly to the lead-through opening through the sleeve wherein at least one latching flap obliquely protrudes outwards from the sleeve of the adapter element; and a contact element adapted to be inserted into the lead-through opening and latched to the sleeve.

2. The contact assembly according to claim 1, wherein the contact element has a cable connection section and one of a male and female contact section opposite to the cable connection section.

3. The contact assembly according to claim 2, wherein the cable connection section is a crimp-type connection section configured to be crimped onto a conductor of an electrical cable.

4. The contact assembly according to claim 2, wherein the cable connection section is a screw-type connection section, having a screw hole adapted to receive a screw extending through a circumferential surface of the contact element at the cable connection section.

5. The contact assembly according to claim 1, wherein a screw is provided that extends through the threaded bore of the adapter element and into an interior of the contact element.

6. The contact assembly according to claim 1, wherein an axial slit extends along the axial direction of the sleeve of the adapter element.

7. The contact assembly according to claim 1, wherein the adapter element is a stamped and bent part.

8. The contact assembly according to claim 1, further comprising a contact set including the adapter element and at least two different contact elements from the group comprising:

a contact element having a male contact section;

a contact element having a female contact section;

a contact element having a crimp-type connection section; and a contact element having a screw-type connection section, any of the at least two contact elements are adapted to be inserted and latched to the adapter element.

9. A connector assembly, comprising:

a connector housing having:

a contact assembly including:

an adapter element having a sleeve with a lead-through opening extending an axial direction of the sleeve and with a threaded bore extending perpendicularly to the lead-through opening through the sleeve wherein a latching flap obliquely protrudes outwards from the sleeve of the adapter element; and a contact element adapted to be inserted into the lead-through opening and latched to the sleeve, wherein the adapter element is received within the lead-through chambers the connector housing and the contact element is inserted into the lead-through opening of the adapter element received within the connector housing; and a back shell coupled to the connector housing.

10. The connector assembly of claim 9, wherein the back shell is coupled to the connector housing by a rotational coupling.

11. The connector assembly of claim 10, wherein a latching structure configured to secure a relative rotational position of the connector housing and the back shell is formed on each of the connector housing and the back shell.

12. The connector assembly of claim 11, wherein the latching structures of the connector housing and of the back shell are configured to automatically engage at an end position of the rotational coupling.

13. A modular connector set comprising:

a first connector assembly and a second connector assembly, each of the first and second connector assemblies including:

a connector housing having a contact assembly including an adapter element having a sleeve with a lead-through opening extending in an axial direction of the sleeve and with a threaded bore extending perpendicularly to the lead-through opening through the sleeve; and a contact element adapted to be inserted into the lead-through opening and latched to the sleeve, the adapter element is received within the connector housing and the contact element is inserted into the lead-through opening of the adapter element received within the connector housing; and at least one male contact and at least one female contact configured to be mated to the at least one male contact, the at least one male contact and the at least one female contact being configured to be selectively inserted into the lead-through opening of the adapter element received within any one of the connector housing of the first connector assembly and the connector housing of the second connector assembly.

14. The modular connector set of claim 13, wherein the connector housing further includes a back shell coupled to the connector housing, the connector housing of the first connector assembly being configured to be mounted on the connector housing of the second connector assembly.

15. The modular connector set of claim 14, therein the back shell is coupled to the connector housing by a rotational coupling.

16. The modular connector set of claim 13, wherein the connector housing of the first connector assembly comprises at least one latching hook adapted to engage in a latching connection with the connector housing of the second connector assembly.

17. The modular connector set of claim 16, wherein the connector housing of the second connector assembly comprises at least one button for disengaging the latching connection.

* * * * *